US011480196B2

(12) United States Patent
Ishida

(10) Patent No.: US 11,480,196 B2
(45) Date of Patent: Oct. 25, 2022

(54) AXIAL FAN

(71) Applicant: Nidec Corporation, Kyoto (JP)

(72) Inventor: Ryosuke Ishida, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 274 days.

(21) Appl. No.: 16/166,193

(22) Filed: Oct. 22, 2018

(65) Prior Publication Data

US 2019/0145429 A1 May 16, 2019

(30) Foreign Application Priority Data

Nov. 16, 2017 (JP) ..... JP2017-220644

(51) Int. Cl.

| | |
|---|---|
| ***F04D 29/66*** | (2006.01) |
| ***F04D 29/38*** | (2006.01) |
| ***F04D 29/52*** | (2006.01) |
| ***F04D 25/08*** | (2006.01) |
| ***F04D 19/00*** | (2006.01) |

(52) U.S. Cl.

CPC ..... *F04D 29/661* (2013.01); *F04D 19/002* (2013.01); *F04D 25/08* (2013.01); *F04D 29/384* (2013.01); *F04D 29/522* (2013.01)

(58) Field of Classification Search

CPC .... F04D 29/661; F04D 19/002; F04D 29/384; F04D 29/522; F04D 25/08; F04D 29/54

See application file for complete search history.

(56) References Cited

U.S. PATENT DOCUMENTS 7,018,175 B2 * 3/2006 Horng ..... F04D 29/541 257/E23.099
7,275,911 B2 * 10/2007 Lee ..... F04D 25/0613 415/211.2
7,329,091 B2 * 2/2008 Yan ..... F04D 25/0613 415/191
7,997,859 B2 * 8/2011 Li ..... F04D 29/542 415/175

(Continued)

FOREIGN PATENT DOCUMENTS

JP 56-012714 U 2/1981
JP 05-202893 A 8/1993

(Continued)

OTHER PUBLICATIONS

Raw Machine Translation of JP2000220597 (A), Takemoto Shinji, "Fan Device", Aug. 8, 2000.*

*Primary Examiner* — Charles G Freay
*Assistant Examiner* — Lilya Pekarskaya
(74) *Attorney, Agent, or Firm* — Keating & Bennett

(57) ABSTRACT

An axial fan includes an impeller rotatable about a central axis extending in a vertical direction, a motor, and a housing. The motor includes a stator and a rotor. The impeller includes blades on a radially outer surface of an impeller cup fixed to the rotor. The housing includes a motor base portion below the motor to support the stator, a tubular portion radially outside of the impeller, a first rib below the blades to join the motor base portion to the tubular portion, and a second rib being annular, centered on the central axis, and joined to the first rib. A lower edge of each blade includes a first blade region that is convex downward. A radially inner end of the second rib is radially outward of a lower end of the first blade region.

15 Claims, 6 Drawing Sheets

(56) References Cited

U.S. PATENT DOCUMENTS

| | | | | |
|---|---|---|---|---|
| 8,172,524 | B2 * | 5/2012 | Uchise | F04D 25/0613 415/211.2 |
| 2004/0091355 | A1 | 5/2004 | Rubenstein et al. | |
| 2005/0002784 | A1 * | 1/2005 | Li | F04D 29/542 415/220 |
| 2006/0045774 | A1 * | 3/2006 | Lu | F04D 29/545 417/423.7 |
| 2007/0031248 | A1 * | 2/2007 | Hsu | F04D 29/544 415/191 |
| 2007/0122271 | A1 * | 5/2007 | Ishihara | F04D 25/0646 415/191 |
| 2010/0247344 | A1 * | 9/2010 | Yang | F04D 29/384 417/410.1 |
| 2013/0149134 | A1 * | 6/2013 | Kobayashi | F04D 25/082 415/208.2 |
| 2014/0086730 | A1 * | 3/2014 | Chang | F04D 29/544 415/143 |
| 2016/0003487 | A1 | 1/2016 | Iwase et al. | |
| 2018/0058479 | A1 * | 3/2018 | Zhong | F04D 29/522 |

FOREIGN PATENT DOCUMENTS

| | | | |
|---|---|---|---|
| JP | 2000-220597 | A | 8/2000 |
| JP | 2005-76590 | A | 3/2005 |
| WO | 2014/128908 | A1 | 8/2014 |

* cited by examiner

AXIAL FAN

CROSS REFERENCE TO RELATED APPLICATIONS

This application claims the benefit of priority to Japanese Patent Application No. 2017-220644 filed on Nov. 16, 2017. The entire contents of this application are hereby incorporated herein by reference.

BACKGROUND OF THE INVENTION

1. Field of the Invention

The present disclosure relates to an axial fan.

2. Description of the Related Art

A known heat dissipation fan which is an axial fan typically includes a housing and a fan wheel. An annular air flow guide ring and ribs arranged in a radial manner are arranged at a wind outlet of the known housing. This arrangement allows air flows to be divided at the wind outlet to increase wind pressure, reduce noise, and/or increase whole heat dissipation efficiency.

It seems that a relative relationship between the structure of the fan wheel and the arrangement of the air flow guide ring was not taken into account when designing the known heat dissipation fan. Thus, the known heat dissipation fan may not be able to achieve improvements in air-blowing characteristics and noise characteristics.

SUMMARY OF THE INVENTION

An axial fan according to a preferred embodiment of the present disclosure includes an impeller rotatable about a central axis extending in a vertical direction, a motor that rotates the impeller, and a housing outward of the impeller and the motor. The motor includes a stator, and a rotor rotatable about the central axis with respect to the stator. The impeller includes an impeller cup fixed to the rotor, and a plurality of blades arranged in a circumferential direction on a radially outer surface of the impeller cup. The housing includes a motor base portion below the motor to support the stator; a tubular portion radially outside of the impeller, and extending in an axial direction; a first rib below the blades to join the motor base portion and the tubular portion to each other; and a second rib being annular, centered on the central axis, and joined to the first rib. A lower edge of each blade includes a first blade region that is convex downward. A radially inner end of the second rib is radially outward of a lower end of the first blade region.

The above and other elements, features, steps, characteristics and advantages of the present disclosure will become more apparent from the following detailed description of the preferred embodiments with reference to the attached drawings.

DETAILED DESCRIPTION OF THE PREFERRED EMBODIMENTS

Figure 1:
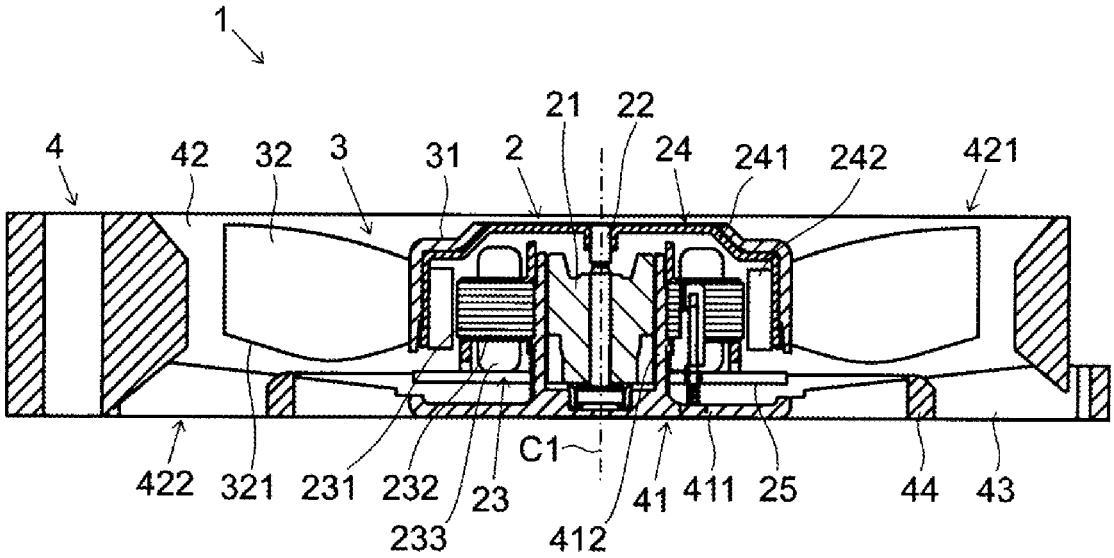
FIG. 1 is a vertical sectional view of an example of an axial fan according to a preferred embodiment of the present disclosure.

Hereinafter, preferred embodiments of the present disclosure will be described in detail with reference to the accompanying drawings. It is assumed herein that a direction in which a central axis of an axial fan extends is referred to simply by the term "axial direction", "axial", or "axially", that directions perpendicular to the central axis of the axial fan and centered on the central axis are each referred to simply by the term "radial direction", "radial", or "radially", and that a direction along a circular arc centered on the central axis of the axial fan is referred to simply by the term "circumferential direction", "circumferential", or "circumferentially". It is also assumed herein that an axial direction is a vertical direction for the sake of convenience in description, and the shape of each member or portion and relative positions of different members or portions will be described on the assumption that a vertical direction and upper and lower sides in FIG. 1 are a vertical direction and upper and lower sides of the axial fan. The upper side of the axial fan corresponds to an inlet side, while the lower side of the axial fan corresponds to an outlet side. It should be noted, however, that the above definition of the vertical direction and the upper and lower sides is not meant to restrict in any way the orientation of, or relative positions of different members or portions of, an axial fan according to any preferred embodiment of the present disclosure when in use. It is also assumed herein that a section parallel to the axial direction is referred to as a "vertical section". Note that the wording "parallel" as used herein includes not only "exactly parallel" but also "substantially parallel".

Figure 2:
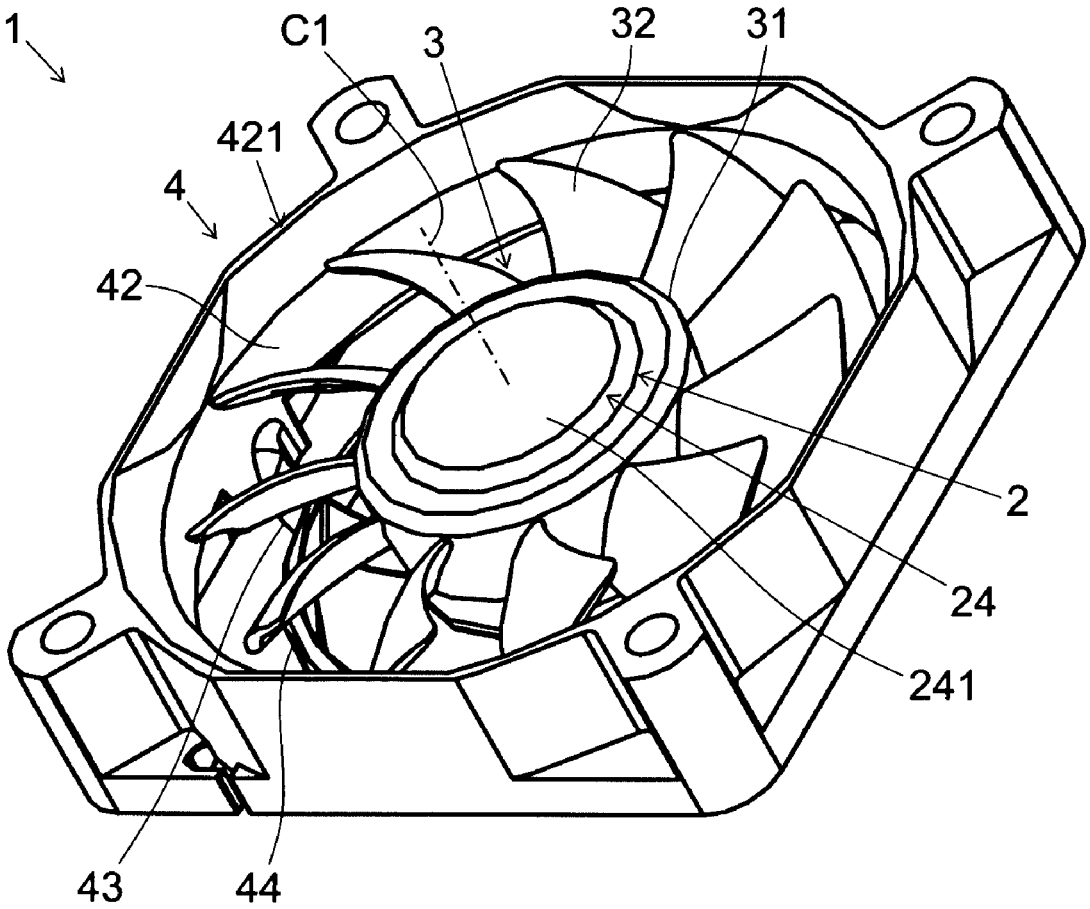
FIG. 2 is a perspective view of an axial fan according to a preferred embodiment of the present disclosure as viewed from above.
Figure 3:
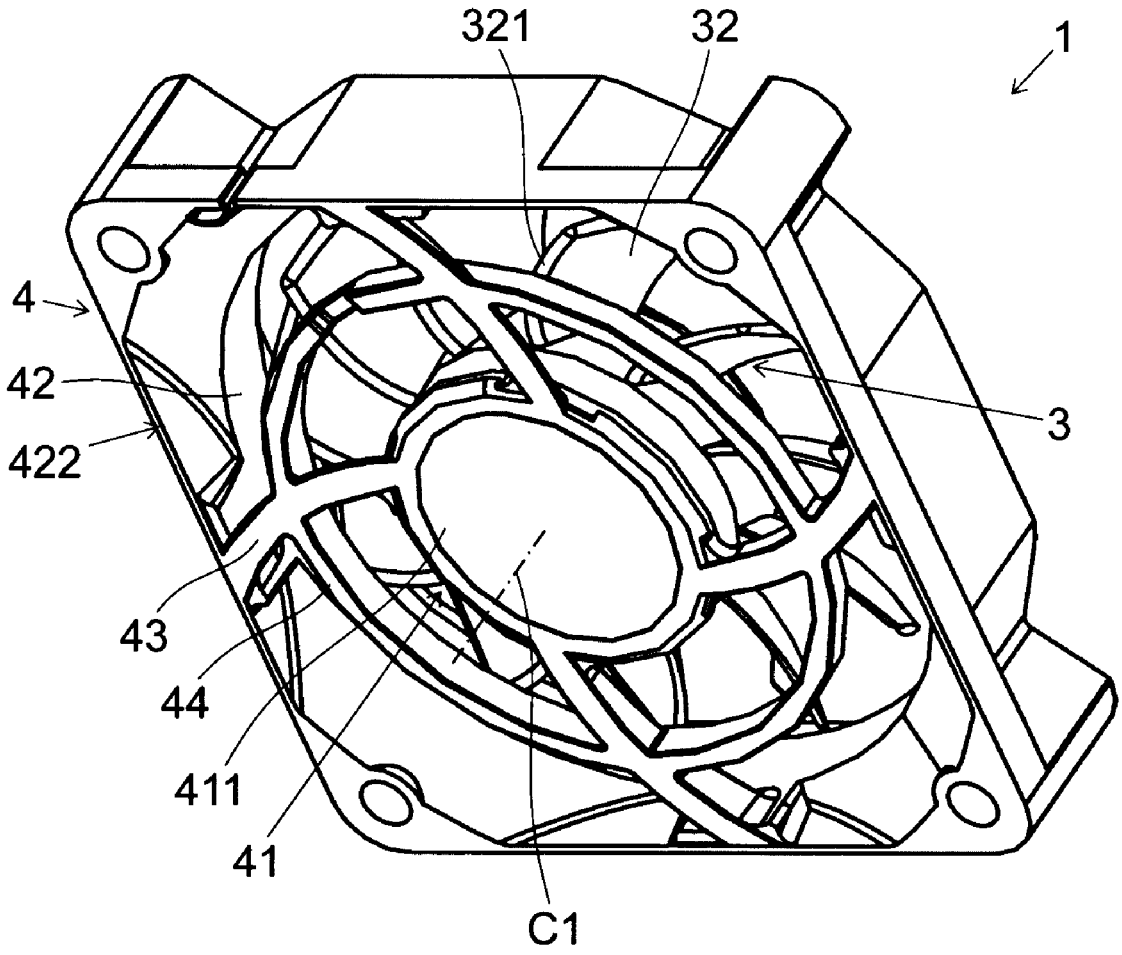
FIG. 3 is a perspective view of an axial fan according to a preferred embodiment of the present disclosure as viewed from below.
Figure 4:
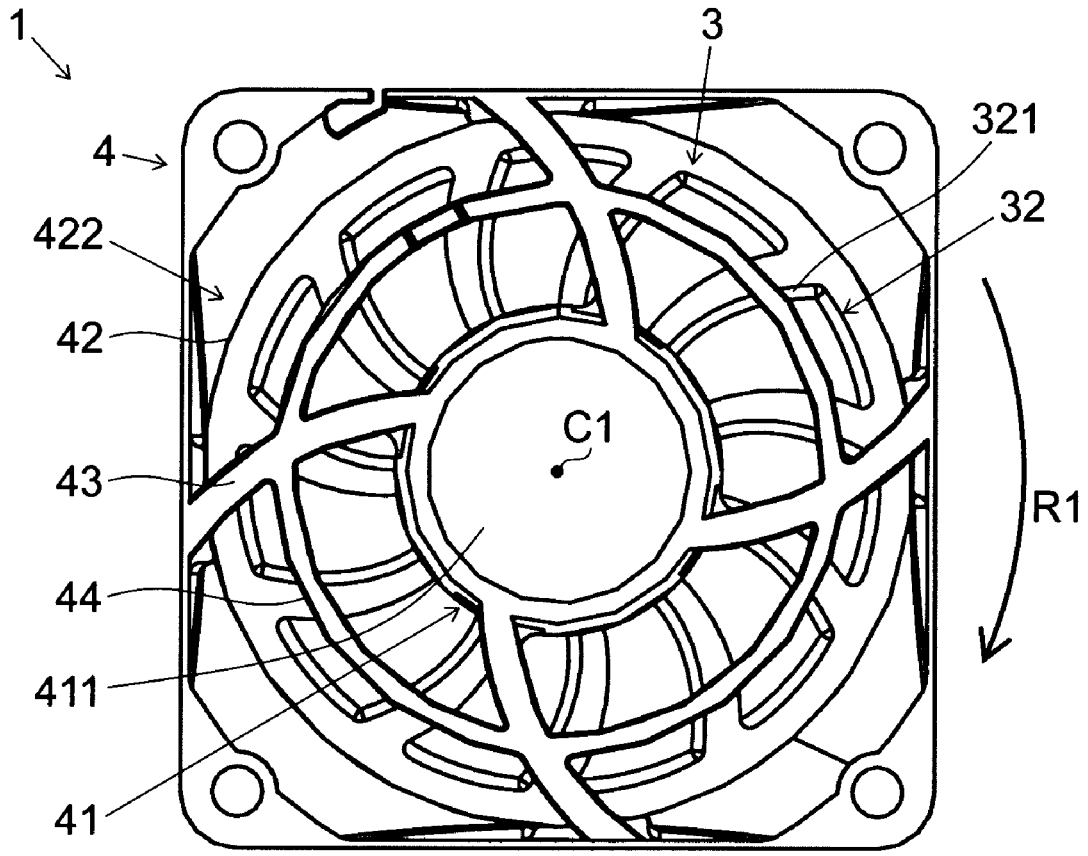
FIG. 4 is a bottom view of an axial fan according to a preferred embodiment of the present disclosure.

FIG. 1 is a vertical sectional view of an example of an axial fan 1 according to a preferred embodiment of the present disclosure. FIG. 2 is a perspective view of the axial fan 1 according to a preferred embodiment of the present disclosure as viewed from above. FIG. 3 is a perspective view of the axial fan 1 according to a preferred embodiment of the present disclosure as viewed from below. FIG. 4 is a bottom view of the axial fan 1 according to a preferred embodiment of the present disclosure.

The axial fan 1 includes a motor 2, an impeller 3, and a housing 4.

The motor 2 is arranged radially inside of the housing 4. The motor 2 is supported by a motor base portion 41, which will be described below, of the housing 4. The motor 2 is arranged to rotate the impeller 3 about a central axis C1 extending in the vertical direction. The motor 2 includes a stator 23 and a rotor 24. In more detail, the motor 2 includes a bearing 21, a shaft 22, the stator 23, the rotor 24, and a circuit board 25.

The bearing 21 is held inside of a cylindrical bearing holding portion 412 of the motor base portion 41. The bearing 21 is defined by a sleeve bearing. Note that the bearing 21 may alternatively be defined by a pair of upper and lower ball bearings.

The shaft 22 is arranged to extend along the central axis C1. The shaft 22 is a columnar member arranged to extend in the vertical direction, and is made of, for example, a metal, such as stainless steel. The shaft 22 is supported by the bearing 21 to be rotatable about the central axis C1.

The stator 23 is fixed to an outer circumferential surface of the bearing holding portion 412 of the motor base portion 41. The stator 23 includes a stator core 231, an insulator 232, and coils 233.

The stator core 231 is defined by electromagnetic steel sheets, such as, for example, silicon steel sheets, placed one upon another in the vertical direction. The insulator 232 is made of a resin having an insulating property. The insulator 232 is arranged to surround an outer surface of the stator core 231. Each coil 233 is defined by a conducting wire wound around a portion of the stator core 231 with a portion of the insulator 232 therebetween.

The rotor 24 is arranged above and radially outside of the stator 23. The rotor 24 is arranged to rotate about the central axis C1 with respect to the stator 23. The rotor 24 includes a rotor yoke 241 and a magnet 242.

The rotor yoke 241 is a member being substantially cylindrical and having an upper cover, and is made of a magnetic material. The rotor yoke 241 is fixed to the shaft 22. The magnet 242 is cylindrical, and is fixed to an inner circumferential surface of the rotor yoke 241. The magnet 242 is arranged radially outside of the stator 23. A radially inner pole surface of the magnet 242 includes north and south poles arranged to alternate with each other in a circumferential direction.

The circuit board 25 is arranged below the stator 23. Lead wires from the coils 233 are electrically connected to the circuit board 25. An electronic circuit arranged to supply electric drive currents to the coils 233 is mounted on the circuit board 25.

The impeller 3 is arranged radially inside of the housing 4 and above and radially outside of the motor 2. The impeller 3 is made of a resin. The impeller 3 is arranged to rotate about the central axis C1 extending in the vertical direction. The motor 2 is arranged to rotate the impeller 3. That is, the impeller 3 is caused by the motor 2 to rotate about the central axis C1. The impeller 3 includes an impeller cup 31 and a plurality of blades 32.

The impeller cup 31 is fixed to the rotor 24. The impeller cup 31 is a member being substantially cylindrical and having an upper cover. The rotor yoke 241 is fixed to an inside of the impeller cup 31. The blades 32 are arranged in the circumferential direction on a radially outer surface of the impeller cup 31. In the present preferred embodiment, the blades are arranged at regular intervals in the circumferential direction. The structure of the impeller 3 will be described in detail below.

The housing 4 is arranged outward of the motor 2 and the impeller 3. The housing 4 includes the motor base portion 41, a tubular portion 42, first ribs 43, and a second rib 44.

The motor base portion 41 is arranged below the motor 2. The motor base portion 41 includes a base portion 411 and the bearing holding portion 412. The base portion 411 is arranged below the stator 23, and is in the shape of a disk, extending radially with the central axis C1 as a center. The bearing holding portion 412 is arranged to project upward from an upper surface of the base portion 411. The bearing holding portion 412 is cylindrical with the central axis C1 in a center. The bearing 21 is housed and held inside of the bearing holding portion 412. The stator 23 is fixed to a radially outer surface of the bearing holding portion 412. The motor base portion 41 is thus arranged to support the stator 23.

The tubular portion 42 is arranged radially outside of the impeller 3. The tubular portion 42 is arranged to extend in the axial direction. The tubular portion 42 is cylindrical. An air inlet 421, which is a circular opening, is arranged at an upper end of the tubular portion 42. An air outlet 422, which is a circular opening, is arranged at a lower end of the tubular portion 42.

The first ribs 43 and the second rib 44 are arranged below the blades 32 and adjacent to the air outlet 422. Each first rib 43 is arranged to join the motor base portion 41 and the tubular portion 42 to each other. That is, each first rib 43 is arranged below the blades 32 to join the motor base portion 41 and the tubular portion 42 to each other. The second rib 44 is annular and is centered on the central axis C1, and is joined to the first ribs 43. The structure of the housing 4 will be described in detail below.

In the axial fan 1 having the above-described structure, once the electric drive currents are supplied to the coils 233 of the stator 23, radial magnetic flux is generated in the stator core 231. A magnetic field generated by the magnetic flux of the stator 23 and a magnetic field generated by the magnet 242 interact with each other to produce a circumferential torque in the rotor 24. This torque causes the rotor 24 and the impeller 3 to rotate about the central axis C1. The impeller 3 is arranged to rotate in a clockwise direction, i.e., in a rotation direction R1 illustrated in FIG. 4, when viewed from below the axial fan 1. The rotation of the impeller 3 causes the blades 32 to generate an air flow. That is, the axial fan 1 performs air blowing, with the generated air flow traveling downward from the inlet side to the outlet side.

Figure 5:
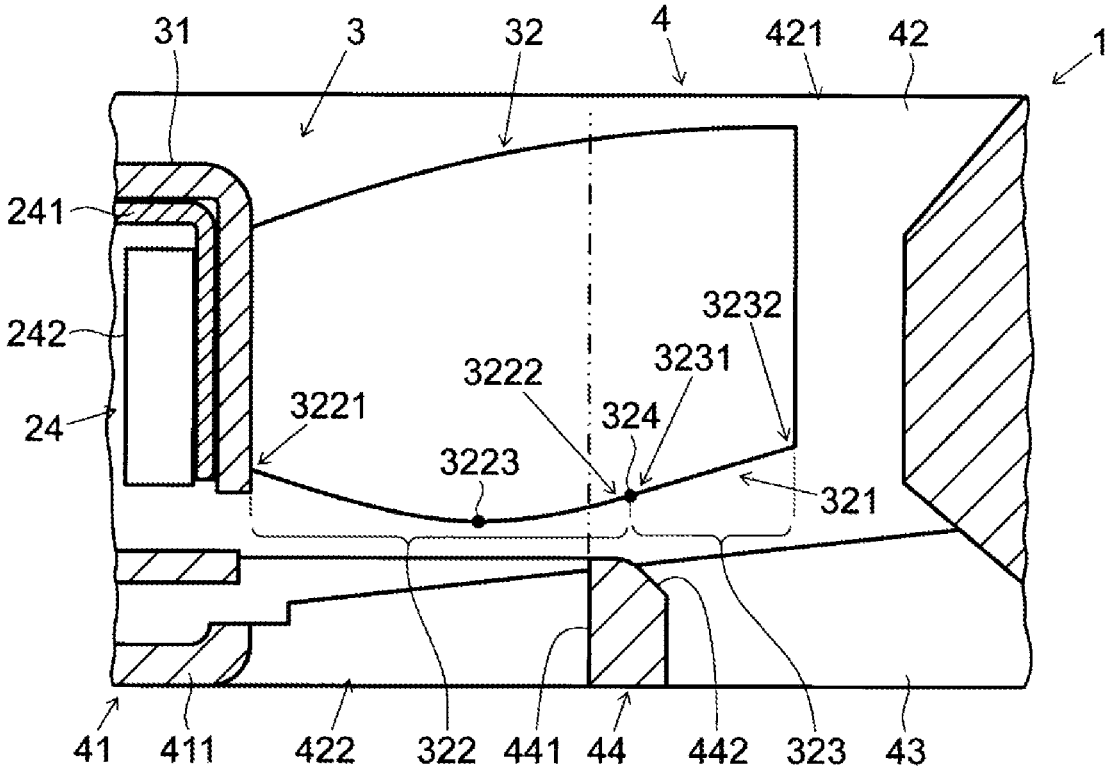
FIG. 5 is a partial vertical sectional view of an axial fan according to a preferred embodiment of the present disclosure.

FIG. 5 is a partial vertical sectional view of the axial fan 1 according to a preferred embodiment of the present disclosure. The central axis C1, which is not shown in FIG. 5, lies to the left of FIG. 5. That is, the left and right sides of FIG. 5 correspond to a radially inner side and a radially outer side, respectively, with respect to the axial fan 1.

Each of the blades 32 of the impeller 3 is arranged to extend from the radially outer surface of the impeller cup 31 in a direction away from the central axis C1. A radially outer end of the blade 32 is arranged close to a radially inner surface of the tubular portion 42 of the housing 4.

A lower edge 321 of each blade 32 includes a first blade region 322 and a second blade region 323. The first blade region 322 and the second blade region 323 are arranged one behind the other in the direction away from the central axis C1. The first blade region 322 is arranged closer to the central axis C1 than is the second blade region 323. That is, the first blade region 322 is arranged adjacent to the impeller cup 31. The second blade region 323 is arranged on the side of the first blade region 322 away from the central axis C1.

A radially inner end 3221 of the first blade region 322 is joined to the radially outer surface of the impeller cup 31. A radially outer end 3222 of the first blade region 322 is joined to a radially inner end 3231 of the second blade region 323. That is, the radially outer end 3222 of the first blade region 322 and the radially inner end 3231 of the second blade region 323 are joined to each other at a junction 324. A lower end 3223 of the first blade region 322 is arranged at a level lower than that of each of the radially inner end 3221 and the radially outer end 3222 of the first blade region 322. In other words, the first blade region 322 is arranged to be convex downward. That is, the lower edge 321 of the blade 32 includes the first blade region 322 being convex downward.

The first ribs 43 and the second rib 44 of the housing 4 are arranged between the air outlet 422 and the lower edges 321 of the blades 32 in the axial direction. Within a region in which the first and second ribs 43 and 44 overlap with the blades 32 when viewed in the axial direction, each of an upper end of each first rib 43 and an upper end of the second rib 44 is lower than the lower edge 321 of each blade 32. That is, a predetermined axial gap is provided between each of the first and second ribs 43 and 44 and each blade 32.

The second rib 44 is arranged radially outward of the lower end 3223 of the first blade region 322. More specifically, a radially inner end 441 of the second rib 44 is arranged radially outward of the lower end 3223 of the first blade region 322.

When the first blade region 322 is arranged to be convex downward, and the radially inner end 441 of the second rib 44 is arranged radially outward of the lower end 3223 of the first blade region 322 as described above, an appropriate relative relationship between the structure of the impeller 3 and the arrangement of the second rib 44 is achieved. That is, an effect of reducing an interference of the second rib 44 with an air flow traveling downward from the first blade region 322 to be discharged can be achieved while achieving improved rigidity of the housing 4. This contributes to increasing the flow rate achieved by an operation of the axial fan 1, and reducing noise. Thus, improvements in air-blowing characteristics and noise characteristics of the axial fan 1 can be achieved.

In addition, the first blade region 322 is arranged to curve in the axial direction with increasing distance from the central axis C1. This arrangement leads to an appropriate structure of the first blade region 322. Accordingly, improvements in the air-blowing characteristics and the noise characteristics of the axial fan 1 can be achieved.

In addition, the radially inner end 441 of the second rib 44 is arranged to extend along the axial direction. This arrangement allows an air flow generated by the first blade region 322 to be guided downward. Accordingly, an improvement in the air-blowing characteristics can be achieved. More specifically, the radially inner end 441 of the second rib 44 is cylindrical, and is arranged to extend along, or parallel to, the axial direction.

The lower edge 321 of each blade 32 includes the second blade region 323. The second blade region 323 is arranged radially outward of the first blade region 322. The second blade region 323 is arranged to extend in a straight line in the direction away from the central axis C1. More specifically, the second blade region 323 is arranged to extend in a straight line from the radially inner end 3231 to a radially outer end 3232 when viewed in the circumferential direction. In addition, the radially inner end 441 of the second rib 44 is arranged radially inward of the radially inner end 3231 of the second blade region 323. This arrangement leads to an appropriate relative relationship between the structure of the second blade region 323 and the arrangement of the second rib 44. That is, an effect of reducing an interference of the second rib 44 with an air flow traveling downward from the second blade region 323 to be discharged can be achieved. Thus, improvements in air-blowing characteristics and noise characteristics involved with an air flow generated by the second blade region 323 can be achieved.

In addition, the second blade region 323 is arranged to slant upward with increasing distance from the central axis C1. This arrangement leads to an appropriate structure of the second blade region 323, and to improvements in the air-blowing characteristics and the noise characteristics. In particular, the slant of the second blade region 323 causes an air flow to travel farther away from the central axis C1 while traveling downward, and this contributes to reducing the interference of the second rib 44 with the air flow traveling downward from the second blade region 323 to be discharged.

In addition, the second rib 44 includes a radially outer surface 442 arranged to decrease in axial height in a radially outward direction. This arrangement allows the air flow generated by the second blade region 323 to be guided radially outward and downward. Thus, an improvement in the air-blowing characteristics can be achieved. More specifically, the radially outer surface 442 of the second rib 44 may include either a curved surface or a flat surface.

Referring to FIG. 4, the lower edge 321 of each blade 32 is arranged to curve forward in the rotation direction R1 of the impeller 3 with increasing distance from the central axis C1. This arrangement leads to an appropriate structure of the whole blade 32 of the impeller 3. That is, this enables the blades 32 to discharge more air downward, leading to improvements in the air-blowing characteristics and the noise characteristics.

Further, each first rib 43 is arranged to curve rearward in the rotation direction R1 of the impeller 3 with increasing distance from the central axis C1. This arrangement helps to cause an air flow generated by the rotation of the impeller 3 and traveling radially outward to be guided downward. Thus, an improvement in the air-blowing characteristics of the axial fan 1 can be achieved. Moreover, because the lower edge 321 of each blade 32 as a whole does not cross an upper side of any first rib 43 at the same time when the impeller 3 is rotating, an effect of reducing noise can be achieved. A vertical section of each first rib 43 is arranged to increase in circumferential dimension in a downward direction, for example.

Referring to FIG. 5, a lower end of each blade 32 coincides with the lower end 3223 of the first blade region 322 of the blade 32. In addition, the lower end 3223 of the blade 32 is arranged at a level lower than that of a lower end of the impeller cup 31. This arrangement leads to a reduced size and a reduced cost of the axial fan 1. That is, a reduction in axial dimension of the impeller cup 31 can be achieved while maintaining the size of each blade 32. Accordingly, a reduced size of the impeller cup 31 can be achieved, and a reduction in the amount of a material needed to mold the impeller 3 can be achieved.

Note that, in the lower edge 321 of each blade 32, the first blade region 322 and the second blade region 323 may not be directly joined to each other. In other words, other regions (not shown), e.g., a third region, a fourth region, etc., may be arranged between the first blade region 322 and the second blade region 323. Even in this case, improvements in the air-blowing characteristics and the noise characteristics of the axial fan 1 can be achieved as in the above-described preferred embodiment.

Figure 6:
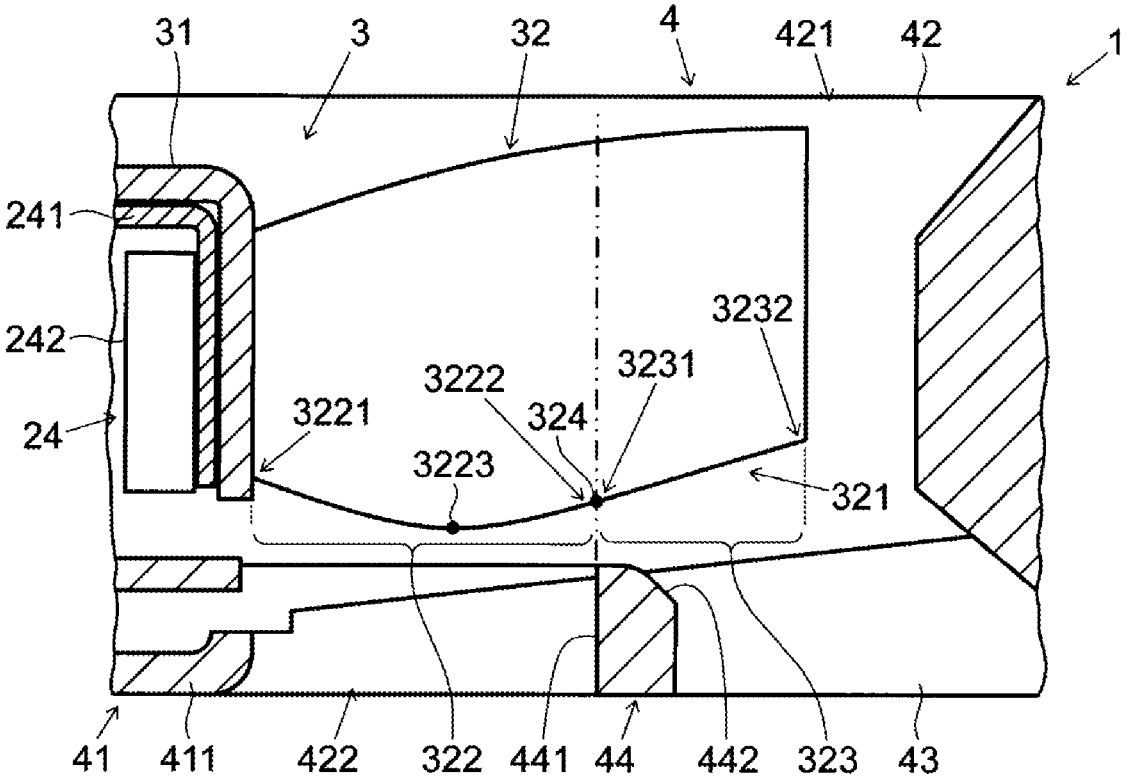
FIG. 6 is a partial vertical sectional view of an axial fan according to a modification of the above preferred embodiment of the present disclosure.

FIG. 6 is a partial vertical sectional view of an axial fan 1 according to a modification of the above-described preferred embodiment of the present disclosure. A central axis C1, which is not shown in FIG. 6, lies to the left of FIG. 6. That is, the left and right sides of FIG. 6 correspond to a radially inner side and a radially outer side, respectively, with respect to the axial fan 1.

A lower edge 321 of each of blades 32 of an impeller 3 includes a first blade region 322 and a second blade region 323. The second blade region 323 is joined to a radially outer end 3222 of the first blade region 322. More specifically, the first blade region 322 and the second blade region 323 are directly joined to each other without any other region arranged therebetween. The second blade region 323 is arranged to extend in a straight line in a direction away from the central axis C1. That is, the lower edge 321 of each blade 32 includes the second blade region 323 joined to the radially outer end of the first blade region 322, and arranged to extend in a straight line in the direction away from the central axis C1. In addition, the radial position of a radially inner end 441 of a second rib 44 is arranged to coincide with the radial position of a junction 324 between the first blade region 322 and the second blade region 323.

The above arrangement leads to an appropriate relative relationship between the structure of the second blade region 323 and the arrangement of the second rib 44. That is, an effect of reducing an interference of the second rib 44 with an air flow traveling downward from the second blade region 323 to be discharged can be achieved. Thus, improvements in air-blowing characteristics and noise characteristics involved with an air flow generated by the second blade region 323 can be achieved.

While preferred embodiments of the present disclosure have been described above, it will be understood that the scope of the present disclosure is not limited to the above-described preferred embodiments, and that various modifications may be made to the above-described preferred embodiments without departing from the gist of the present disclosure. In addition, features of the above-described preferred embodiments and the modifications thereof may be combined appropriately as desired.

Preferred embodiments of the present disclosure are applicable to, for example, axial fans.

Features of the above-described preferred embodiments and the modifications thereof may be combined appropriately as long as no conflict arises.

While preferred embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. An axial fan comprising:

an impeller rotatable about a central axis extending in a vertical direction;

a motor that rotates the impeller; and a housing arranged outward of the impeller and the motor; wherein the motor includes:

a stator; and a rotor rotatable about the central axis with respect to the stator;

the impeller includes:

an impeller cup fixed to the rotor; and a plurality of blades arranged in a circumferential direction on a radially outer surface of the impeller cup;

the housing includes:

a motor base portion below the motor to support the stator;

a tubular portion that is radially outside of the impeller and extends in an axial direction;

a first rib located axially lower than the blades and joining the motor base portion and the tubular portion to each other; and a second rib being annular, centered on the central axis, and joined to the first rib;

a lower edge of each of the plurality of blades includes:

a first blade region that is convex downward and curves to extend upward in the axial direction with increasing distance from the central axis in a radial direction; and a second blade region that is joined to a radially outer end of the first blade region, the second blade region including a flat surface extending in a straight line which slants upward in the axial direction with increasing distance from the central axis in the radial direction;

a radially inner end of the second rib is radially outward of a lower end of the first blade region;

the second rib includes a radially outer surface that has an axial height which decreases as the radially outer surface extends in a radially outward direction;

the tubular portion of the housing includes an inclined portion which extends downward toward a lower end of the axial fan in the vertical direction with a constant slope, the inclined portion overlapping at least a portion of the second rib when viewed in the radial direction; and a junction between the first blade region and the second blade region is located between the radially inner end of the second rib and a radially outer end of the second rib when viewed from the axial direction.

2. The axial fan according to claim 1, wherein the radially inner end of the second rib extends along the axial direction.

3. The axial fan according to claim 1, wherein the radially inner end of the second rib is radially inward of a radially inner end of the second blade region.

4. The axial fan according to claim 1, wherein a radial position of the radially inner end of the second rib coincides with a radial position of the junction between the first blade region and the second blade region.

5. The axial fan according to claim 1, wherein the lower edge of each of the plurality of blades is curved forward in a rotation direction of the impeller with increasing distance from the central axis.

6. The axial fan according to claim 5, wherein the first rib is curved rearward in the rotation direction of the impeller with increasing distance from the central axis.

7. The axial fan according to claim 1, wherein a lower end of each of the plurality of blades is at a level lower than that of a lower end of the impeller cup.

8. An axial fan comprising:

an impeller rotatable about a central axis extending in a vertical direction;

a motor that rotates the impeller; and a housing arranged outward of the impeller and the motor; wherein the motor includes:

a stator; and a rotor rotatable about the central axis with respect to the stator;

the impeller includes:

an impeller cup fixed to the rotor; and a plurality of blades arranged in a circumferential direction on a radially outer surface of the impeller cup;

the housing includes:

a motor base portion below the motor to support the stator;

a tubular portion that is radially outside of the impeller and extends in an axial direction;

a first rib located axially lower than the blades and joining the motor base portion and the tubular portion to each other; and a second rib being annular, centered on the central axis, and joined to the first rib;

a lower edge of each of the plurality of blades includes:

a first blade region that is convex downward and curves to extend upward in the axial direction with increasing distance from the central axis in a radial direction; and a second blade region that is joined to a radially outer end of the first blade region, the second blade region including a flat surface extending in a straight line which slants upward in the axial direction with increasing distance from the central axis in the radial direction;

a radially inner end of the second rib is radially outward of a lower end of the first blade region;

a total distance between a radially outer surface of the second rib and the tubular portion of the housing, is longer than a total length of the second blade region; and a junction between the first blade region and the second blade region is located between the radially inner end of the second rib and a radially outer end of the second rib when viewed from the axial direction.

9. The axial fan according to claim 8, wherein the radially inner end of the second rib extends along the axial direction.

10. The axial fan according to claim 8, wherein the radially inner end of the second rib is radially inward of a radially inner end of the second blade region.

11. The axial fan according to claim 8, wherein a radial position of the radially inner end of the second rib coincides with a radial position of the junction between the first blade region and the second blade region.

12. The axial fan according to claim 8, wherein the second rib includes the radially outer surface that decreases in axial height in a radially outward direction.

13. The axial fan according to claim 8, wherein the lower edge of each of the plurality of blades is curved forward in a rotation direction of the impeller with increasing distance from the central axis.

14. The axial fan according to claim 13, wherein the first rib is curved rearward in the rotation direction of the impeller with increasing distance from the central axis.

15. The axial fan according to claim 8, wherein a lower end of each of the plurality of blades is at a level lower than that of a lower end of the impeller cup.

* * * * *